US005860055A

United States Patent [19]

Hesse et al.

[11] Patent Number: 5,860,055

[45] Date of Patent: Jan. 12, 1999

[54] PROCESS FOR PRODUCING GRANULAR MATERIAL AND SHAPED PARTS FROM HARD METAL MATERIALS OR CERMET MATERIALS

[75] Inventors: Werner Hesse, Obrigheim; Knut Bittler, Speyer, both of Germany

[73] Assignee: BASF Aktiengesellschaft, Ludwigshafen, Germany

[21] Appl. No.: 826,078

[22] Filed: Mar. 24, 1997

[30] Foreign Application Priority Data

Apr. 9, 1996 [DE] Germany ..... 196 14 006.4

[51] Int. Cl.[6] ..... B22F 3/10

[52] U.S. Cl. ..... 419/36; 419/13; 419/14; 419/16; 419/23; 419/57; 419/58; 419/2

[58] Field of Search ..... 419/36, 2, 13, 419/14, 16, 23, 57, 58

[56] References Cited

U.S. PATENT DOCUMENTS

| | | | |
|---|---|---|---|
| 5,397,531 | 3/1995 | Peiris et al. | 419/36 |
| 5,415,830 | 5/1995 | Zhang et al. | 419/36 |
| 5,525,293 | 6/1996 | Kagawa et al. | 419/65 |
| 5,574,959 | 11/1996 | Tsujioka et al. | 419/2 |
| 5,603,071 | 2/1997 | Kitagawa et al. | 419/15 |
| 5,604,919 | 2/1997 | Sterzel et al. | 419/30 |
| 5,641,920 | 6/1997 | Hens et al. | 75/228 |
| 5,665,289 | 9/1997 | Chung et al. | 264/628 |
| 5,678,165 | 10/1997 | Wu | 419/37 |

*Primary Examiner*—Daniel J. Jenkins
*Attorney, Agent, or Firm*—Keil & Weinkauf

[57] ABSTRACT

In a process for producing granular material in which at least one hard material phase is mixed with a metal powder and a binder and granulated, no premixing of the hard material phase and the metal powder takes place before mixing with the binder and the binder has a viscosity of from 20 to 200 $cm^3$/10 min, preferably from 30 to 100 $cm^3$/10 min, in accordance with DIN 53735 at 195° C. and a load of 2.16 kg.

9 Claims, No Drawings

PROCESS FOR PRODUCING GRANULAR MATERIAL AND SHAPED PARTS FROM HARD METAL MATERIALS OR CERMET MATERIALS

The present invention relates to a process for producing shaped parts by injection molding granular material comprising a material mixture of a hard material phase, a metal powder and an organic binder, and also a process for producing such granular materials.

Injection-molded shaped parts comprising cemented hard materials or cermet materials are produced by shaping a granular material for injection molding corresponding to the needs of the individual case, removing the binder and sintering. Such processes are widely described in the literature, eg. in EP-A's 0 413 231, 0 444 475, 0 446 708 and 0 465 940.

The granular material for injection molding is produced by mixing, eg. kneading, a hard material phase and a metal component with an organic binder. The metal component here generally comprises a binder metal which leads to better adhesion of the particles of the hard material phase to one another. Until now, the metallic component and the hard material phase have had to be mixed with one another before being mixed with the organic binder, in order to later obtain a homogeneous particle distribution in the granular material and, for example, to prevent the formation of "lakes" of binder. This premixing is usually carried out by milling, eg. in ball mills, with at least one solvent such as alcohol being added. The necessity of premixing is described, for example, in EP-B 0 443 048 and EP-B 0 516 165. The heat generated during milling results in a "placing" of the softer component on the harder component. This produces particularly long-lasting homogeneous mixing of the components. This placing effect is described, for example, by D. R. Moyle, Proceedings of 1993 Powder Metallurgy World Congress, pages 1244 to 1247 (Japan Society of Powder and Powder Metallurgy).

A disadvantage of the previous processes is their considerable outlay for the production of a very homogeneous granular material for injection molding, especially the necessary premixing of the components which can take, for instance in a mill, up to 48 hours.

It is an object of the present invention to provide a process for producing a granular material for injection molding which is technically less complicated but leads to comparably good results. The homogeneity of the granular material and the advantageous material properties of the shaped part resulting therefrom should be maintained to the greatest extent possible.

We have found that this object is achieved by the following process for producing granular material. Here, at least one hard material phase is mixed with a metal powder and a binder and granulated, wherein no premixing of the hard material phase and the metal powder takes place before mixing with the binder and the binder has a viscosity of from 20 to 200 $cm^3$/10 min, preferably from 30 to 100 $cm^3$/10 min, in accordance with DIN 53735 at 195° C. and a load of 2.16 kg. In general, the metal powder is a binder metal powder which improves the adhesion of the particles to one another. Both the hard material phase and the metal phase can also consist of a plurality of different materials.

Apart from the hard material phase, the metal component and the binder, the granular material can also contain organic additives for the purposes of dispersing and surface modification. In addition, wetting agents, plasticizers or other auxiliaries which influence the rheological properties of the granular material during shaping can also be mixed into the granular material.

Contrary to expectations, the use of binders having the viscosity indicated enables the premixing step of the metal component and the hard material phase to be omitted. This is attributed to the fact that the mixing of these components with the high-viscosity organic binder leads to high shear forces in the mixture, so that agglomerates of particles of the hard material phase or the metal component are dispersed or cannot be formed. This gives a very homogeneous distribution of the components in the granular material, and this is reflected in corresponding properties of the finished shaped part. The use of the process of the present invention also improves the flow properties of the granular material during injection molding, by which means the shaping of complex parts is made considerably easier. Finally, the binder removal times are also significantly shortened.

The mixing of the metal component and the hard material phase with the binder can in principle be carried out by all known, appropriate methods. Typically, the components are extruded or kneaded at from 150° to 200° C., then cooled and granulated.

Binders which allow the omission of the premixing step are, in particular, high-viscosity binders which comprise, preferably consist of, at least 70% by weight of at least one polyacetal, in particular at least one polyoxymethylene or polyoxymethylene homopolymer or copolymer. The viscosity of this first component of the binder is preferably from 25 to 50 $cm^3$/10 min in accordance with DIN 53735 at 195° C. and a load of 2.16 kg, so that the indicated total viscosity of the binder results. As a second component of the binder, it is possible to use up to 30% by weight of further polymers, preferably polybutanediol formal, polyethylene or polypropylene or a mixture of at least two of these polymers. Polybutanediol formal here preferably has a relative molecular mass of from 6000 to 80,000. Polyacetal binders which, with a suitable viscosity, can be used for the purposes of the present invention are also described in EP 413 231, EP 444 475, EP 446 708 and EP 465 940. The proportion by volume of the binder in the granular material is preferably from 30 to 70%.

Preference is given to a process in which the hard material phase used is a powder of at least one carbide, nitride or carbonitride of boron or a transition metal, in particular an element of group IVa, Va or VIa of the Periodic Table. The metal powder used is preferably at least one element powder or alloy powder of an element selected from the group consisting of Fe, Co, Ni, Cr, Mo, W, preferably Co, Ni or Cr.

Preferably, either the metal powder or the hard material phase or both powders has/have a mean particle size of less than 40 $\mu$m, preferably less than 20 $\mu$m.

The present invention also provides a process for producing shaped parts by injection molding, wherein a granular material produced by means of a process as described above is shaped, subjected to binder removal and sintered. The shaping of the injection-molded parts can be carried out by feeding the granular material into molds by means of conventional screw or plunger-type injection-molding machines and shaping it at, typically, from 170° to 200° C. and pressures of from 200 to 2000 bar. The removal of the binder from the shaped green body is preferably carried out in an atmosphere comprising acid, in particular oxalic acid, or boron trifluoride. This is especially the case for polyacetal binders of the above-described type. For other binders, other binder removal conditions may be more favorable. Finally, sintering is preferably carried out in an inert gas atmosphere, in a reducing atmosphere or under reduced pressure. In appropriate cases, sintering can also be carried out under superatmospheric inert gas pressure. The sintering conditions have to be matched to the individual case in question, since these are of great importance for the correct setting of the carbon content of the shaped part. The carbon content in turn is of decisive importance for the material properties obtained.

EXAMPLE ACCORDING TO THE PRESENT INVENTION

In an example according to the present invention, a mixture of the following components was placed in a heatable kneader: 8800 g of pulverulent WC which had been doped with 0.1% by weight of NbC and had a mean particle size of 2.2 $\mu$m; 1200 g of pulverulent Co having a mean particle size of 1.6 $\mu$m; 40 g of polyethylene glycol having a mean molecular weight of about 800; 35 g of polybutanediol formal having a mean molecular weight of about 30,000; 850 g of polyoxymethylene containing 2% by weight of butanediol formal. This mixture was melted at 175° C. and homogenized for one hour. It was subsequently cooled and granulated. The granular material had a melt flow index in accordance with DIN 53735, measured at 190° C. and a load of 10 kg, of 27 $cm^3$/10 min.

The granular material was injection molded to give shaped parts which were subsequently subjected to binder removal in an oxalic acid/nitrogen atmosphere at 140° C. The binder-removal rate was 1 mm/h, ie. during each hour of the binder removal process, the green shaped part became binder-free to a further depth of 1 mm all around. Sintering in an inert gas atmosphere at 1450° C. gave shaped parts having a density of 14.3 g/ml and a homogeneous microstructure. There were no "lakes" of binder and no agglomerates of WC particles. The three-point flexural strength in accordance with DIN-ISO 3327 was 2200 MPa for the as-fired specimens.

Comparative Example 1

In the comparative example, a mixture of the following components was placed in a heatable kneader: 8800 g of pulverulent WC which had been doped with 0.1% by weight of NbC and had a mean particle size of 2.2 $\mu$m, and 1200 g of pulverulent Co having a mean particle size of 1.6 $\mu$m; as binder, 600 g of montan ester wax which had a viscosity so low that measurement of the melt flow index was not possible and 60 g of low density polyethylene (LDPE) were added. This mixture was melted at 120° C. and homogenized for one hour. It was subsequently cooled and granulated. The granular material had a melt flow index in accordance with DIN 53735, measured at 140° C. and a load of 2.16 kg, of 21 $cm^3$/10 min.

This granular material was injection molded to give shaped parts. The subsequent binder removal was carried out as follows: heating of the shaped part in two steps, first to 350° C. at a rate of 10 K/h in a nitrogen atmosphere, then further to 650° C. at a rate of 50 K/h under reduced pressure (maximum pressure 0.7 mbar); holding of the temperature reached for 1 hour; cooling. The binder-free shaped parts were subsequently sintered in an inert gas atmosphere at 1450° C., giving shaped parts having a density of 13.9 g/ml. The microstructure was not sufficiently homogeneous: "lakes" of binder and pores were visible in photomicrographs. The three-point flexural strength in accordance with DIN-ISO 3327 was 1530 MPa for the as-fired specimens.

Comparative Example 2

In a comparative example, a mixture of 88% by weight of WC powder and 12% by weight of Co powder in alcohol was first wet milled in a ball mill for 48 hours. The powder mixture was subsequently dried and processed into a granular material as in the above example according to the present invention using the other components indicated there. The melt flow index of the granular material was 16 $cm^3$/10 min, measured in accordance with DIN 53735 at 190° C. and a load of 21.6 kg.

The granular material was injection molded as in the example according to the present invention. The green shaped parts obtained were subjected to binder removal under identical conditions to those used above, with the binder removal rate being only 0.5 mm/h. Sintering gave shaped parts whose microstructure and properties were largely identical with the parts produced using the process of the present invention, as in the above example.

Comparative Example 2 shows that the process of the present invention enables premixing to be omitted while still producing homogeneous shaped parts which have good strength and, in addition, are able to have the binder removed more easily. It is also advantageous that the granular material produced by the process of the present invention has better flow, which makes the shaping of complex parts easier. Comparative Example 1 shows, on the other hand, that if in the case of hitherto customary binders premixing is omitted there is considerable impairment of the homogeneity and the strength of the shaped parts.

We claim:

1. A process for producing granular material in which at least one hard material phase is mixed with a metal powder and a binder and granulated, wherein no premixing of the hard material phase and the metal powder takes place before mixing with the binder and the binder has a viscosity of from 20 to 200 $cm^3$/10 min, preferably from 30 to 100 $cm^3$/10 min, in accordance with DIN 53735 at 195° C. and a load of 2.16 kg.

2. A process as claimed in claim 1, wherein the binder comprises a) from 70 to 100% by weight of at least one polyacetal, in particular at least one polyoxymethylene or polyoxymethylene homopolymer or copolymer, where this component preferably has a viscosity of from 25 to 50 $cm^3$/10 min in accordance with DIN 53735 at 195° C. and a load of 2.16 kg, and b) from 0 to 30% by weight of further polymers, in particular polybutanediol formal, preferably having a relative molecular mass of from 6000 to 80,000, polyethylene or polypropylene or a mixture thereof.

3. A process as claimed in claim 1, wherein the proportion by volume of the binder in the granular material is from 30 to 70%.

4. A process as claimed in claim 1, wherein the hard material phase used is a powder of at least one carbide, nitride or carbonitride of boron or a transition metal, in particular an element of group IVa, Va or VIa of the Periodic Table.

5. A process as claimed in claim 1, wherein the metal powder used is at least one element powder or alloy powder of an element selected from the group consisting of Fe, Co, Ni, Cr, Mo, W, preferably Co, Ni or Cr.

6. A process as claimed in claim 1, wherein the hard material phase and/or the metal powder has a mean particle size of less than 40 $\mu$m, preferably less than 20 $\mu$m.

7. A process for producing shaped parts by injection molding, wherein a granular material produced by means of a process as claimed in claim 1 is shaped, subjected to binder removal and sintered.

8. A process as claimed in claim 7, wherein the binder removal is carried out in an atmosphere comprising acid, in particular oxalic acid, or boron trifluoride.

9. A process as claimed in claim 7, wherein sintering is carried out in an inert gas atmosphere, in a reducing atmosphere or under reduced pressure.

* * * * *